US006874392B1

(12) United States Patent
Wu

(10) Patent No.: US 6,874,392 B1
(45) Date of Patent: Apr. 5, 2005

(54) CONNECTOR OF HAND TOOL

(76) Inventor: Keng Hao Wu, No. 1, He-Jiang St., Taichung City (TW)

( * ) Notice: Subject to any disclaimer, the term of this patent is extended or adjusted under 35 U.S.C. 154(b) by 0 days.

(21) Appl. No.: 10/626,654

(22) Filed: Jul. 25, 2003

(51) Int. Cl.[7] ..... B25B 23/16
(52) U.S. Cl. ..... 81/177.85; 81/177.2
(58) Field of Search ..... 81/177.85, 177.2

(56) References Cited

U.S. PATENT DOCUMENTS 4,733,584 A * 3/1988 Karge ..... 81/177.85
4,817,476 A * 4/1989 Karge ..... 81/177.85
4,865,485 A * 9/1989 Finnefrock, Sr. ..... 403/322.2
5,289,745 A * 3/1994 Beardsley ..... 81/177.2
5,433,548 A * 7/1995 Roberts et al. ..... 403/74
5,509,333 A * 4/1996 Rion ..... 81/180.1
5,660,491 A * 8/1997 Roberts et al. ..... 403/74
5,720,207 A * 2/1998 Milner et al. ..... 81/177.85
5,943,924 A * 8/1999 Jarvis ..... 81/177.2
6,006,632 A * 12/1999 Hsieh ..... 81/177.85
6,092,441 A * 7/2000 Jarvis ..... 81/177.2
6,170,365 B1 * 1/2001 Zerver ..... 81/177.85
6,267,032 B1 * 7/2001 Hsieh ..... 81/177.85
6,339,979 B1 * 1/2002 Chiang ..... 81/177.2
6,736,034 B1 * 5/2004 Gonzales ..... 81/177.85

* cited by examiner

*Primary Examiner*—David B. Thomas
(74) *Attorney, Agent, or Firm*—Charles E. Baxley

(57) ABSTRACT

A connector includes a connector seat combined with an operation member and including a main body, a movable rod, a positioning ball, and at least one spring. Thus, the main body is movable relative to the operation seat of the operation member to retract the positioning ball into the receiving cavity of the movable rod, so that the socket can be mounted on and detached from the connector easily and conveniently, thereby saving the manual work.

6 Claims, 9 Drawing Sheets

CONNECTOR OF HAND TOOL

BACKGROUND OF THE INVENTION

1. Field of the Invention

The present invention relates to a connector, and more particularly to a connector for a hand tool, such as the socket, the screwdriver head or the like.

2. Description of the Related Art

A conventional connector comprises an operation seat having a first end formed with a receiving hole for receiving a spring and a positioning ball, and an elongated rod extended through a second end of the operation seat. In assembly, when a hand tool, such as a socket or screwdriver head, is mounted on the operation seat of the conventional connector, the inner wall of the socket is locked by the protruding positioning ball, thereby positioning the socket on the operation seat of the conventional connector. In operation, when the socket is mounted on a workpiece, such as a bolt or nut, the elongated rod can be rotated to produce a larger torque so as to screw or unscrew the bolt.

However, the inner wall of the socket is locked by the protruding positioning ball, so that the socket is fixed on the operation seat closely. Thus, the socket cannot be detached from the operation seat easily and conveniently, thereby causing inconvenience to the user in removing the socket from the operation seat of the conventional connector.

SUMMARY OF THE INVENTION

The present invention is to mitigate and/or obviate the disadvantage of the conventional connector.

The primary objective of the present invention is to provide a connector, wherein the main body is movable relative to the operation seat of the operation member to retract the positioning ball into the receiving cavity of the movable rod, so that the socket can be mounted on and detached from the connector easily and conveniently, thereby saving the manual work.

Another objective of the present invention is to provide a connector, wherein the operation member is moved relative to the main body to move the movable rod to align the receiving cavity with the positioning hole, so that the positioning ball is received in the receiving cavity and is entirely hidden in the positioning hole, thereby releasing the socket from the receiving portion of the main body.

A further objective of the present invention is to provide a connector, wherein after the force applied on the operation member is removed, the operation seat of the operation member is pushed and returned to the original position by the restoring force of the cone-shaped spring of the connector seat, while the movable rod of the connector seat is pushed and returned to the original position by the restoring force of the restoring spring of the connector seat.

A further objective of the present invention is to provide a connector, wherein the connector seat is an independent structure, so that the connector seat can be used to combine with the operation seat of any kinds and types, thereby enhancing the versatility of the connector.

In accordance with the present invention, there is provided a connector, comprising an operation member, and a connector seat, wherein:

the operation member includes an operation seat;

the connector seat is combined with the operation member and includes:

a main body movably mounted on the operation seat of the operation member;

a movable rod slidably mounted in the main body and has a first end rested on an end face of the operation seat of the operation member and a second end having a periphery formed with a receiving cavity;

a positioning ball movably mounted on the main body and aligned with the receiving cavity of the movable rod; and at least one spring mounted on the movable rod and urged between the main body and the movable rod.

Further benefits and advantages of the present invention will become apparent after a careful reading of the detailed description with appropriate reference to the accompanying drawings.

DETAILED DESCRIPTION OF THE INVENTION

Figure 1:
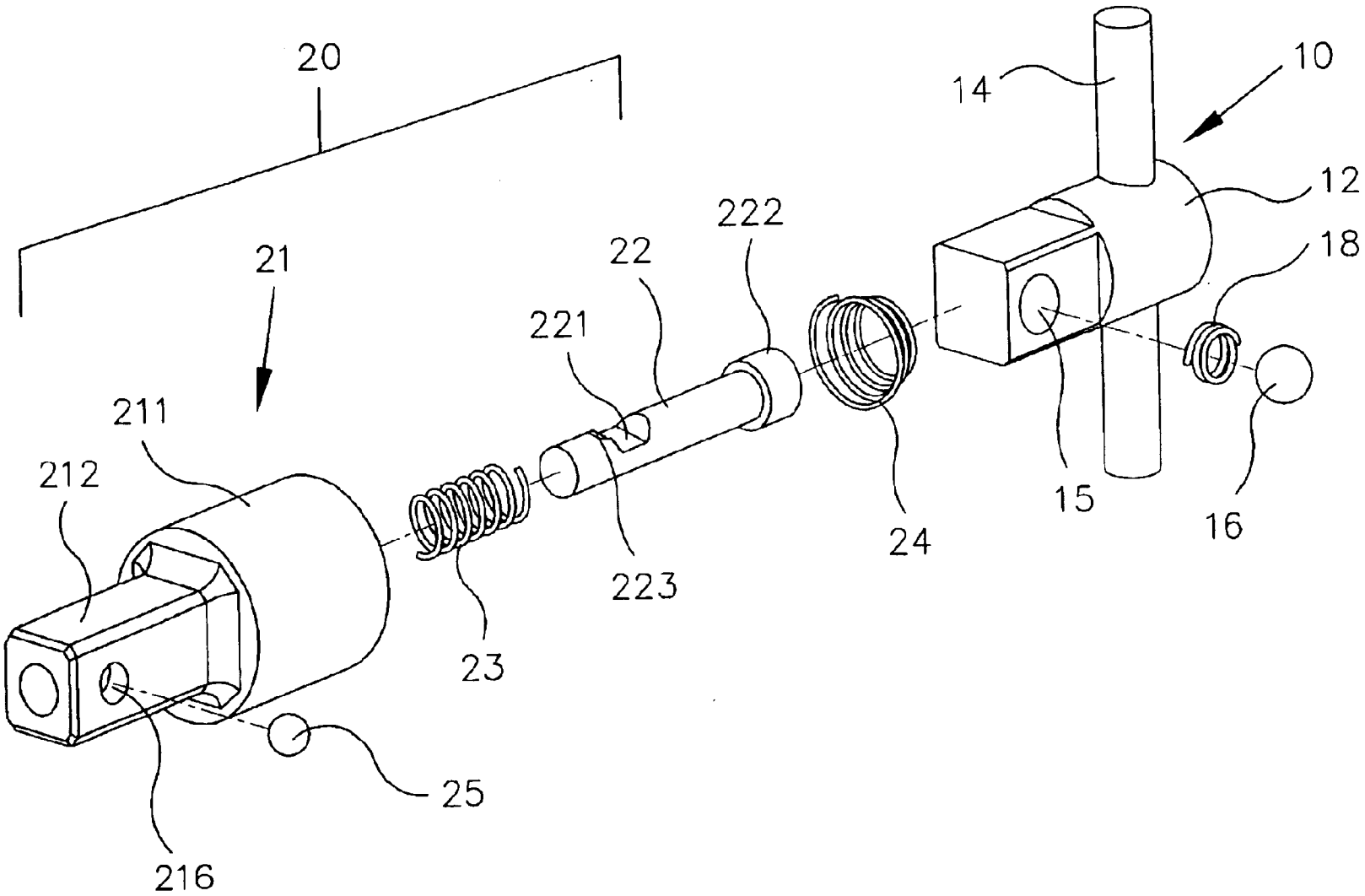
FIG. 1 is an exploded perspective view of a connector in accordance with a first embodiment of the present invention.
Figure 2:
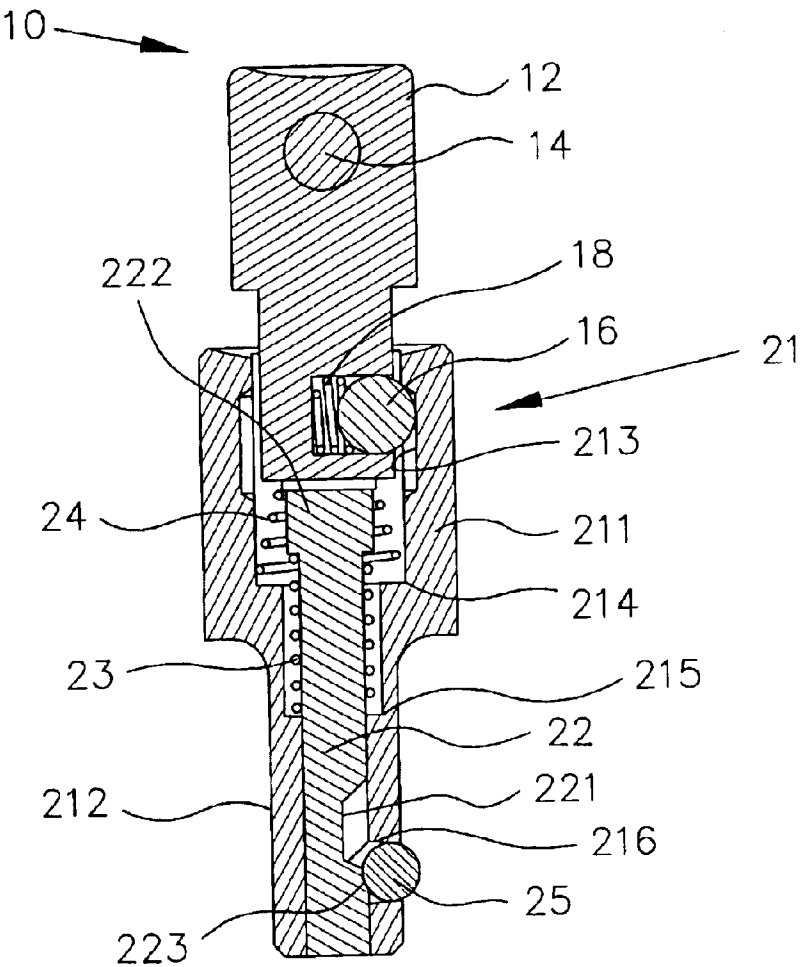
FIG. 2 is a side plan cross-sectional assembly view of the connector as shown in FIG. 1.

Referring to the drawings and initially to FIGS. 1 and 2, a connector in accordance with the first embodiment of the present invention comprises an operation member 10, and a connector seat 20.

The operation member 10 includes an operation seat 12 having a first end formed with a receiving hole 15 for receiving a spring 18 and a retaining ball 16, and an elongated rod 14 extended through a second end of the operation seat 12.

The connector seat 20 is combined with the operation member 10 and includes a main body 21, a movable rod 22, a restoring spring 23, and a cone-shaped spring 24.

The main body 21 of the connector seat 20 is movably mounted on the operation seat 12 of the operation member 10 and has a first end formed with a cylindrical mounting portion 211 and a second end formed with a square receiving portion 212. The mounting portion 211 of the main body 21 of the connector seat 20 has an inner wall formed with an annular slide groove 213, and the retaining ball 16 on the operation seat 12 of the operation member 10 is slidably mounted in the slide groove 213 of the mounting portion 211 of the main body 21. The inner wall of the mounting portion 211 of the main body 21 of the connector seat 20 is formed with a catch edge 214 located between the slide groove 213 and receiving portion 212. The receiving portion 212 of the main body 21 of the connector seat 20 has an inner wall formed with a stop edge 215. The receiving portion 212 of the main body 21 of the connector seat 20 has a periphery formed with a positioning hole 216 communicating with an inside of the receiving portion 212 for receiving a positioning ball 25.

The movable rod 22 of the connector seat 20 is slidably mounted in the main body 21 and has a first end formed with an enlarged head 222 rested on an end face of the first end of the operation seat 12 of the operation member 10 and a second end having a periphery formed with a receiving cavity 221 aligning with the positioning hole 216 of the receiving portion 212 of the main body 21. The receiving cavity 221 of the movable rod 22 has a side formed with an inclined face 223 rested on the positioning ball 25. Thus, when the positioning ball 25 is received in the positioning hole 216 of the receiving portion 212 of the main body 21, the inclined face 223 of the receiving cavity 221 of the movable rod 22 is rested on the positioning ball 25, to push the positioning ball 25 outward from the positioning hole 216 of the receiving portion 212 of the main body 21.

The restoring spring 23 of the connector seat 20 is mounted on the movable rod 22 and has a first end rested on the enlarged head 222 of the movable rod 22 and a second end rested on the stop edge 215 of the receiving portion 212 of the main body 21.

The cone-shaped spring 24 of the connector seat 20 is mounted on the movable rod 22 and has a first end rested on the end face of the first end of the operation seat 12 of the operation member 10 and a second end rested on the catch edge 214 of the mounting portion 211 of the main body 21.

In use, when a hand tool, such as a socket or screwdriver head (not shown) is mounted on the receiving portion 212 of the main body 21, the inner wall of the socket is locked by the protruding positioning ball 25 as shown in FIG. 2, thereby positioning the socket on the receiving portion 212 of the main body 21.

Figure 3:
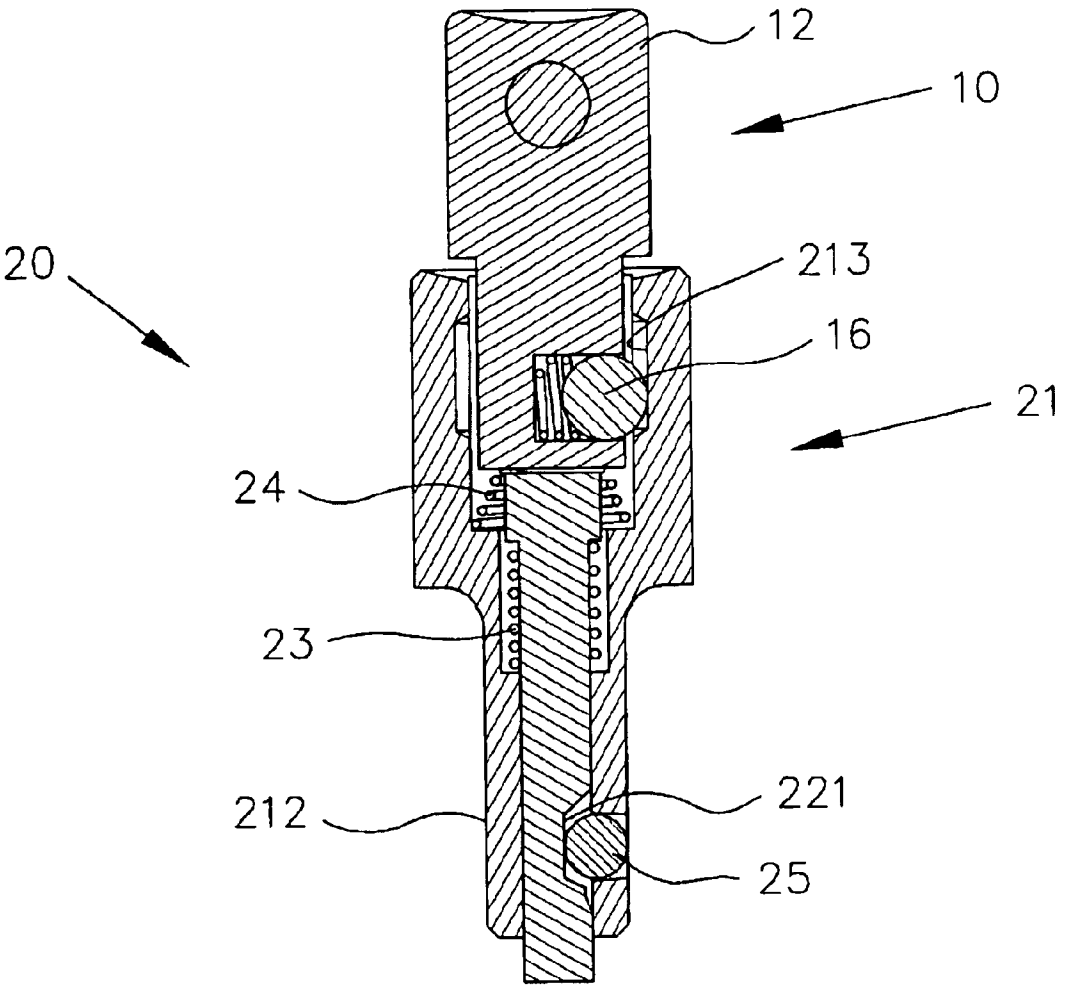
FIG. 3 is a schematic operational view of the connector as shown in FIG. 2 in use.

Referring to FIG. 3 with reference to FIGS. 1 and 2, the user exerts a force to press the operation seat 12 of the operation member 10, so that the operation seat 12 of the operation member 10 is moved toward the main body 21 of the connector seat 20 to press the movable rod 22 of the connector seat 20 to move in the main body 21. Thus, the movable rod 22 of the connector seat 20 is moved in the main body 21 from the position as shown in FIG. 2 to the position as shown in FIG. 3 where the receiving cavity 221 of the movable rod 22 aligns with the positioning hole 216 of the receiving portion 212 of the main body 21, so that the positioning ball 25 is received in the receiving cavity 221 of the movable rod 22 and is entirely hidden in the positioning hole 216 of the receiving portion 212 of the main body 21, thereby releasing the socket from the receiving portion 212 of the main body 21. In addition, the second end of the movable rod 22 is protruded outward from the receiving portion 212 of the main body 21 as shown in FIG. 3, so that the released socket can be detached from the receiving portion 212 of the main body 21 easily and conveniently. Thus, the socket can be mounted on and detached from the receiving portion 212 of the main body 21 easily and conveniently, thereby saving the manual work.

After the force applied on the operation seat 12 of the operation member 10 is removed, the operation seat 12 of the operation member 10 is pushed and returned to the original position by the restoring force of the cone-shaped spring 24 of the connector seat 20, while the movable rod 22 of the connector seat 20 is pushed and returned to the original position by the restoring force of the restoring spring 23 of the connector seat 20.

Accordingly, the connector seat 20 is an independent structure, so that the connector seat 20 can be used to combine with the operation seat 12 of any kinds and types, thereby enhancing the versatility of the connector.

Figure 4:
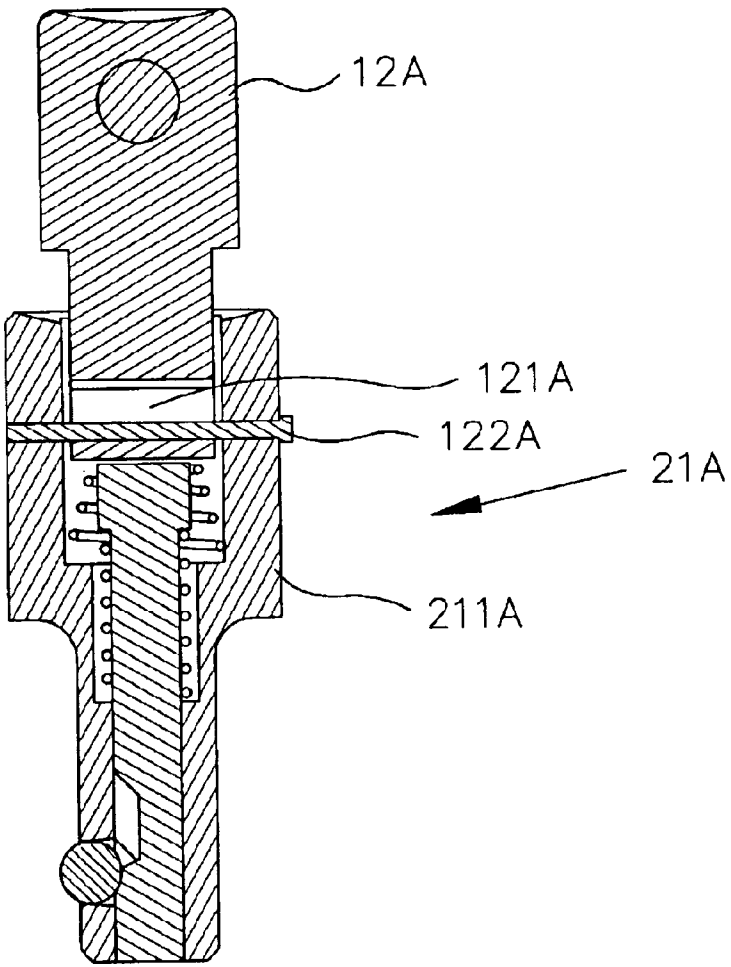
FIG. 4 is a side plan cross-sectional assembly view of a connector in accordance with a second embodiment of the present invention.

Referring to FIG. 4, the connector in accordance with the second embodiment of the present invention is shown, wherein the operation seat 12A is formed with an elongated guide slot 121A, and the connector further comprises a fixing pin 122A extended through the mounting portion 211A of the main body 21A and the guide slot 121A of the operation seat 12A, so that the operation seat 12A is movable relative to the main body 21A.

Figure 5:
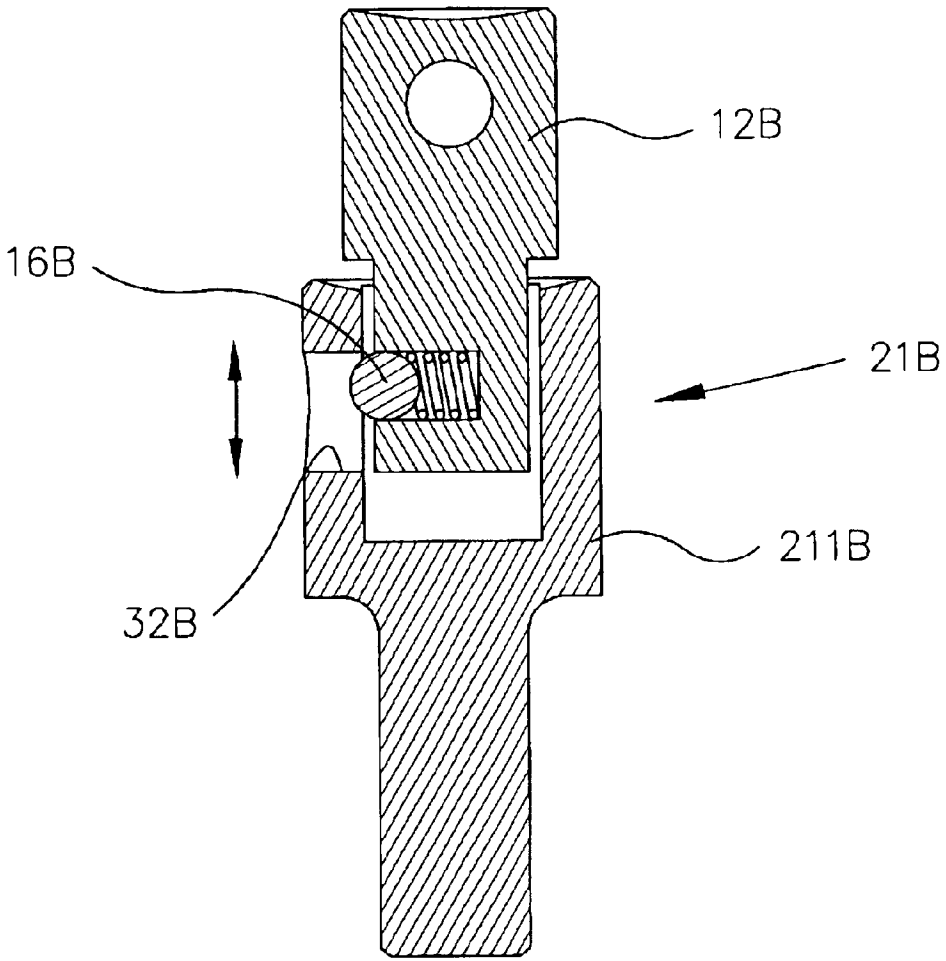
FIG. 5 is a side plan cross-sectional assembly view of a connector in accordance with a third embodiment of the present invention.
Figure 6:
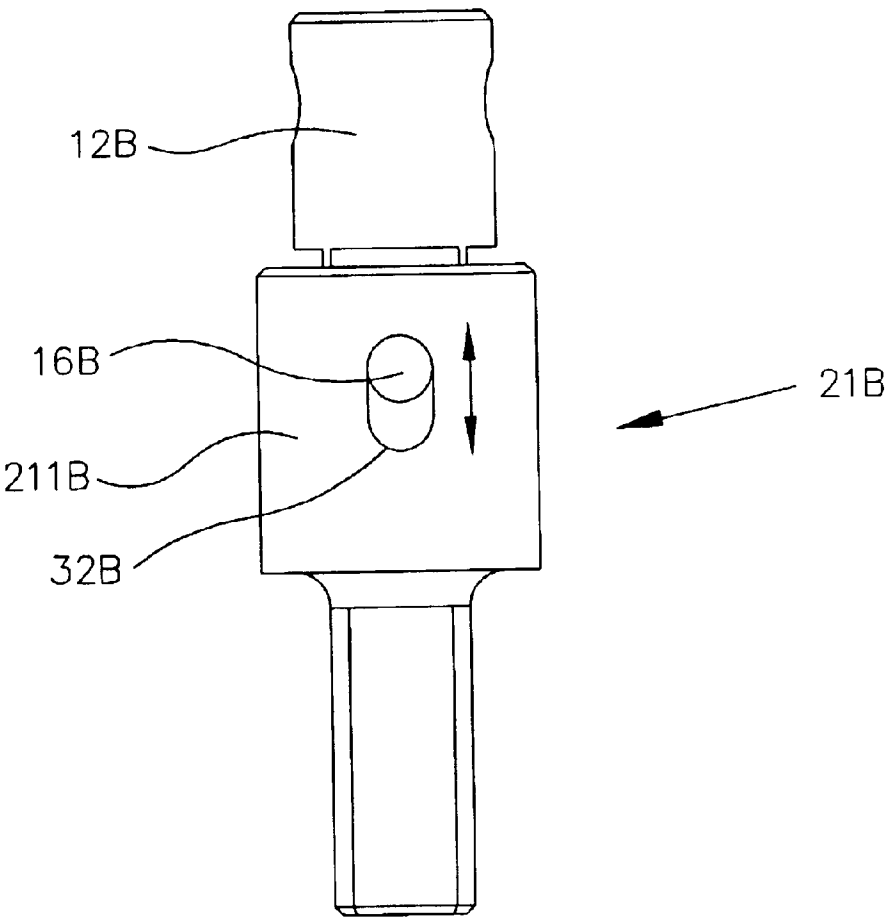
FIG. 6 is a plan view of the connector as shown in FIG. 5.

Referring to FIGS. 5 and 6, the connector in accordance with the third embodiment of the present invention is shown, wherein the mounting portion 211B of the main body 21B has a wall formed with an elongated guide slot 32B to receive and guide the retaining ball 16B of the operation seat 12B, so that the operation seat 12B is movable relative to the main body 21B.

Figure 7:
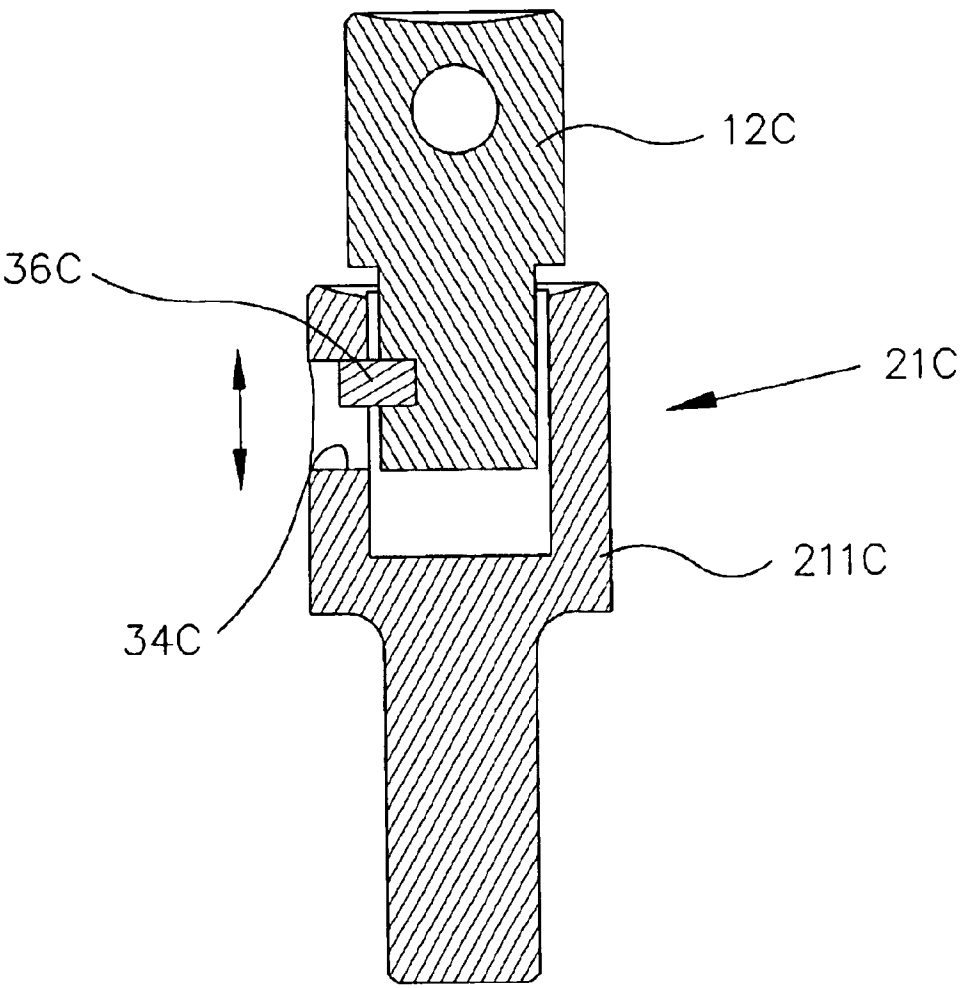
FIG. 7 is a side plan cross-sectional assembly view of a connector in accordance with a fourth embodiment of the present invention.
Figure 8:
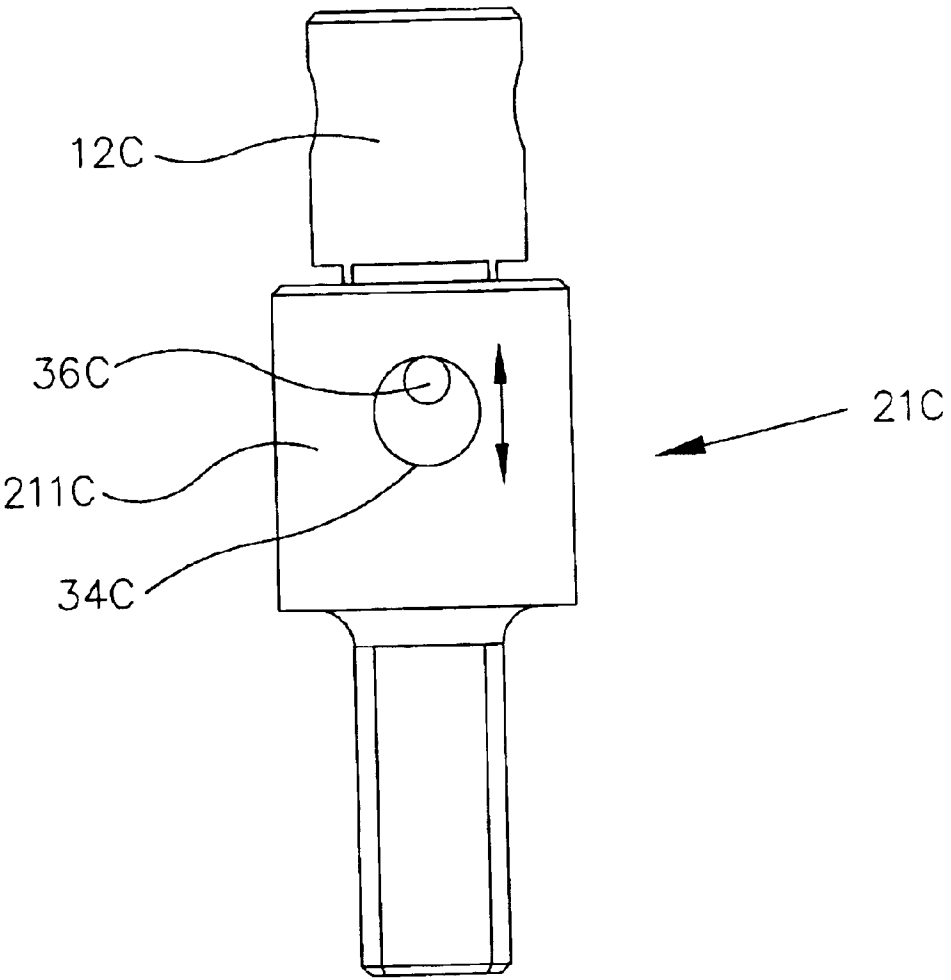
FIG. 8 is a plan view of the connector as shown in FIG. 7.

Referring to FIGS. 7 and 8, the connector in accordance with the fourth embodiment of the present invention is shown, wherein the mounting portion 211C of the main body 21C is formed with an oblong slot 34C, and the operation seat 12C is provided with a retaining pin 36C slidably mounted in the oblong slot 34C of the mounting portion 211C of the main body 21C, so that the operation seat 12C is movable relative to the main body 21C.

Figure 9:
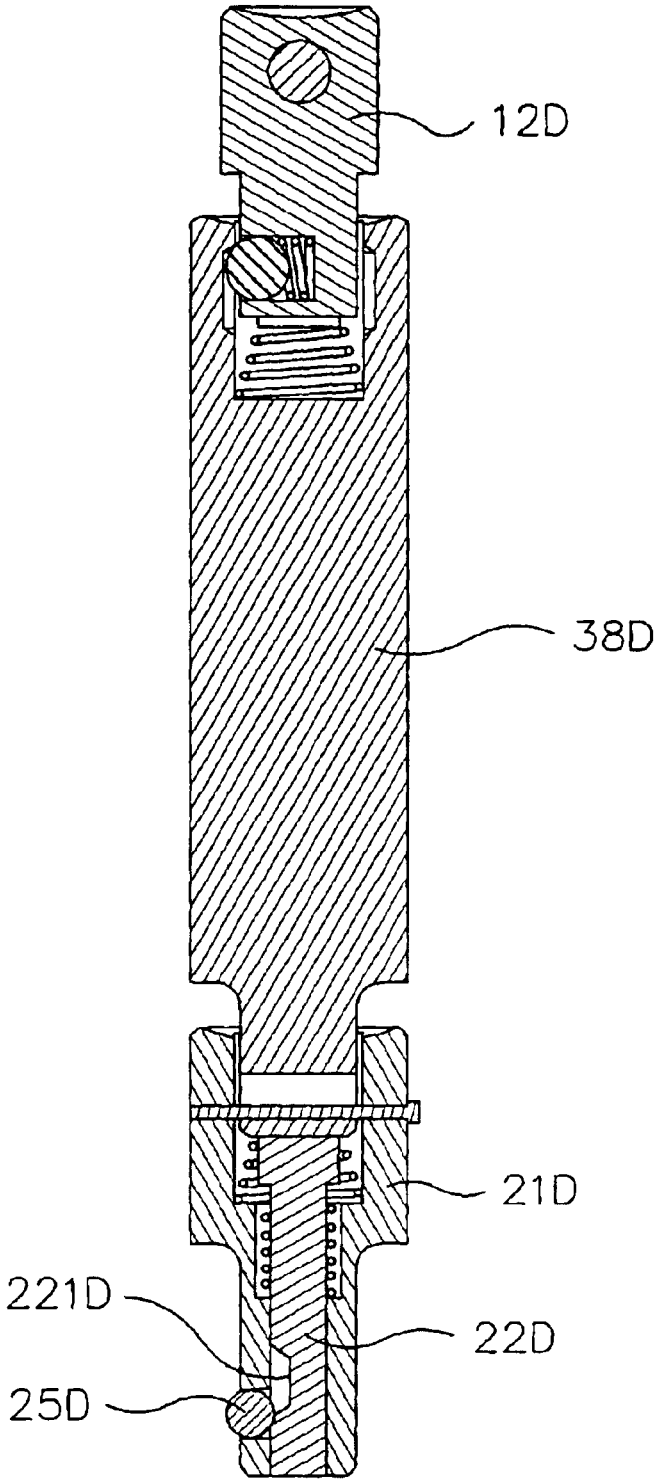
FIG. 9 is a side plan cross-sectional assembly view of a connector in accordance with a fifth embodiment of the present invention.

Referring to FIG. 9, the connector in accordance with the fifth embodiment of the present invention is shown, wherein the connector further comprises an extension 38D mounted between the operation seat 12D and the main body 21D. In practice, the extension 38D is movable relative to the main body 21D, so that the movable rod 22 mounted in the main body 21D is pushed to move the receiving cavity 221D to align with the positioning ball 25D.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A connector, comprising an operation member, and a connector seat, wherein:

the operation member includes an operation seat;

the connector seat is combined with the operation member and includes:

a main body movably mounted on the operation seat of the operation member;

a movable rod slidably mounted in the main body and has a first end rested on an end face of the operation seat of the operation member and a second end having a periphery formed with a receiving cavity;

a positioning ball movably mounted on the main body and aligned with the receiving cavity of the movable rod; and at least one spring mounted on the movable rod and urged between the main body and the movable rode;

the main body of the connector seat has an inner wall formed with an annular elongated slide groove, and the operation seat is provided with a retaining ball slidably mounted in the slide groove of the main body.

2. The connector in accordance with claim 1, further comprising an extension mounted between the operation seat and the main body, wherein the extension is movable relative to the main body and the operation seat and rested on the movable rod, so that the movable rod mounted in the main body is pushed by the extension to move the receiving cavity to align with the positioning ball.

3. The connector in accordance with claim 1, wherein the at least one spring is a restoring spring mounted on the movable rod and having a first end rested on the first end of the movable rod and a second end rested on an inside of the main body.

4. The connector in accordance with claim 1, wherein the at least one spring is a cone-shaped spring mounted on the movable rod and having a first end rested on the end face of the operation seat of the operation member and a second end rested on a stepped inside of the main body.

5. The connector in accordance with claim 1, wherein the receiving cavity of the movable rod has a side formed with an inclined face rested on the positioning ball.

6. The connector in accordance with claim 1, wherein the main body is movable relative to the operation seat of the operation member to retract the positioning ball into the receiving cavity of the movable rod.

* * * * *